United States Patent [19]

Simovits, Jr.

[11] 4,378,511

[45] Mar. 29, 1983

[54] TUBE SOCKET ASSEMBLY WITH CORONA DISRUPTER

[75] Inventor: Stephen S. Simovits, Jr., Downers Grove, Ill.

[73] Assignee: American Plasticraft Company, Chicago, Ill.

[21] Appl. No.: 172,775

[22] Filed: Jul. 28, 1980

[51] Int. Cl.[3] ..... H01J 17/00; H01J 21/00

[52] U.S. Cl. ..... 313/325; 313/318; 313/51; 339/14 T; 339/143 T; 339/192 T; 361/129

[58] Field of Search ..... 313/318, 325, 51; 339/14 T, 143 T, 192 T; 361/129, 130

[56] References Cited

U.S. PATENT DOCUMENTS

| | | | |
|---|---|---|---|
| 3,031,635 | 4/1962 | Gluck | 339/14 T |
| 3,748,521 | 7/1973 | Wright et al. | 313/325 |
| 4,156,161 | 5/1979 | Pittman | 313/325 |
| 4,253,717 | 3/1981 | Stewart | 339/14 T |
| 4,266,158 | 5/1981 | Uda et al. | 313/325 |
| 4,298,815 | 11/1981 | Ishihara et al. | 313/325 |

*Primary Examiner*—Saxfield Chatmon, Jr.
*Attorney, Agent, or Firm*—Leo J. Aubel

[57] ABSTRACT

A cathode ray tube socket is provided which provides spark gap protection to terminal pins operating at selected high potentials through a distinct spark gap protection system, including a structure for disrupting the corona discharge track and minimizing the effects of corona discharge.

1 Claim, 2 Drawing Figures

TUBE SOCKET ASSEMBLY WITH CORONA DISRUPTER

BACKGROUND OF THE INVENTION

Television picture tubes and particularly color television picture tubes which generally operate at high voltages, for example in the 15 KV to 30 KV range, commonly generate undesired large transient voltages, noise and corona within the tube. Such voltages must be controlled and dissipated in order to avoid conduction of these high voltages through the tube pins and tube socket contacts to other portions of the circuitry associated with the tube; otherwise, these large voltages may damage the tube, the tube terminals and may also couple to and damage the associated electronics.

Many structures have been constructed to provide protection against such large transient voltages and such structures have been utilized widely in the commercial products. Note for example, U.S. Pat. No. 3,636,412 to Simovits and Dumas, entitled "Tube Socket Assembly"; U.S. Pat. No. 3,733,522 to Simovits and Dumas, entitled "Arc-Over Protective Device"; and U.S. Pat. No. 3,767,951 to Dumas and Simovits, entitled "Electron Tube Socket", all of which patents are assigned to the same assignee as the present invention.

In order to dissipate the excessive voltages, cathode ray tube sockets are normally provided with some type of safety device in the form of a grounding apparatus. In the event that the pin is operating at an excessive potential, the grounding apparatus permits a spark to jump or arc from the pin contact to ground. The foregoing prevents damage due to excessive potential at the selected one of the pins by providing a non-destructive path to ground to thus eliminate the excessive over voltage.

Commonly, one or more of the terminal pins is connected to higher voltage potentials than the other pins. Accordingly, the spacing between the high voltage arcing terminal and the grounding plate are selected to be greater than the space between the arcing terminals of the remaining pins and the grounding plate so that a higher potential is necessary before a spark can bridge the gap between the high voltage arcing terminal and the grounding plate. However, if a spark jumps from the high voltage arcing terminals to the ground plate, the potential of the ground plate may rise so fast that it can be properly dissipated, thereby causing a second spark to jump from the ground plate back to one of the other pin terminals thus seriously damaging the tube or the associated circuit. Structures are thus provided for separately connecting the high voltage arcing terminals to one grounding plate and grounding the arcing terminals of the remaining pins to a separate grounding plate. The separate grounding plate tends to prevent the sparks from jumping from the high voltage pin to ground and then to the remaining pins.

The present invention further provides an improved tube socket assembly operating at high potentials including dielectric chambers wherein the high voltage pin arc-gap terminals are positioned. The high voltage arc chamber is separated and segregated from the remaining pin contacts and includes a pair of controlled, uniformly spaced, high voltage spark gaps comprising two pairs of spaced hemi-spherical electrodes positioned in spaced relation to each other. The arc chamber is constructed to include a corona disrupter for minimizing the effects of corona discharge, as will be explained.

The foregoing and other objects, features and advantages of the invention will be apparent from the following more particular description of a preferred embodiment of the invention, as illustrated in the accompanying drawings, wherein:

DESCRIPTION OF THE INVENTION

Figure 1:
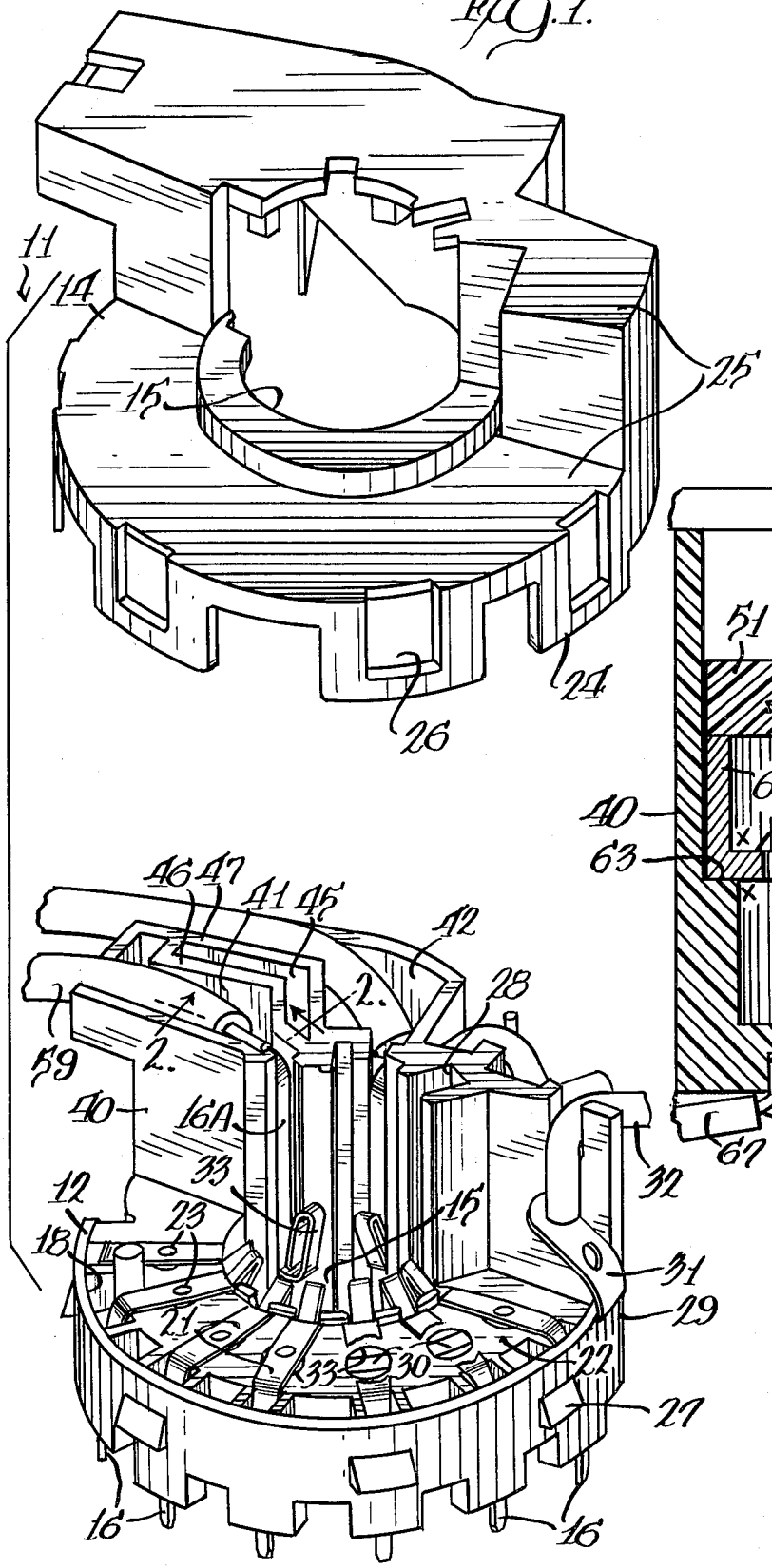
FIG. 1 is an exploded view of the socket showing a socket base including a low voltage spark gap system and a high voltage spark gap system, and a cover plate; and, FIG. 2 is a cross-sectional view taken along the lines 2—2 of FIG. 1 to show the construction of the corona disrupter for the high voltage spark gap system.

FIG. 1 shows an exploded view of the inventive socket assembly 11 comprising a base 12 and a cover 14 both of which are formed or molded of a suitable relatively rigid insulative material such as plastic. The socket 11 includes a central passage 15 for mounting onto the terminal pin portion of the neck of a television picture tube, not shown. The terminal pins generally labeled 16 extend downwardly for purposes of connecting the socket assembly 11 to suitable electrical and electronic circuitry, as is known.

A conductor plate or ring 30, in substantially a semicircle shape, conforms to the shape of a horizontal planar surface 22 on base 12 and is securely embedded as by molding, as is well-known, slightly beneath the surface 22. Conductor plate 30 includes a terminal tab 31 for connecting through an electrical lead 32 to ground reference. Openings 33 are formed in surface 22 to selectively expose sections of the ring 30 to provide one part of an arc gap as will be explained. The pins 16 extend upwardly through suitable apertures 18 in base 12 and are bent over to have a portion 21 which extends horizontally over respective spark gap openings 33 formed on surface 22. Pin portions 21 each include a dimple protrusion 23 which extends downwardly toward, but spaced from, ring 30. This provides the gap across which the low voltage arcing occurs; as is well-known in the art.

The base plate 12 is generally in an irregular circular form, in plan view, as is the entire assembly 11. The base 12 includes an upwardly extending peripheral wall 29 which is irregular in height. The cover 14 includes a peripheral wall 24 which mates with and encircles wall 29. The top 25 of cover 14 comprises two stepped planar surfaces which conform to and provide a cover for base 12. The periphery of opening 15 in base 12 includes one or more positioning notches 28 on its circumference for properly indexing the socket assembly 11 on the neck of the associated tube.

The wall 24 of cover 14 includes vertically extending flexible latches 26 which mate with, or are received by respective positioning catches or shoulders 27 formed on the periphery of the base 12.

The ends 33 of the pins 16A which extend to the periphery of opening 15 provide electrical contact with the picture tube pins. Pin contact ends 33 are bifurcated and are in the form of a spring-biased and centrally cantilevered structure similar to that described in U.S. Pat. No. 3,733,522 assigned to the same assignee as the present invention.

Figure 2:
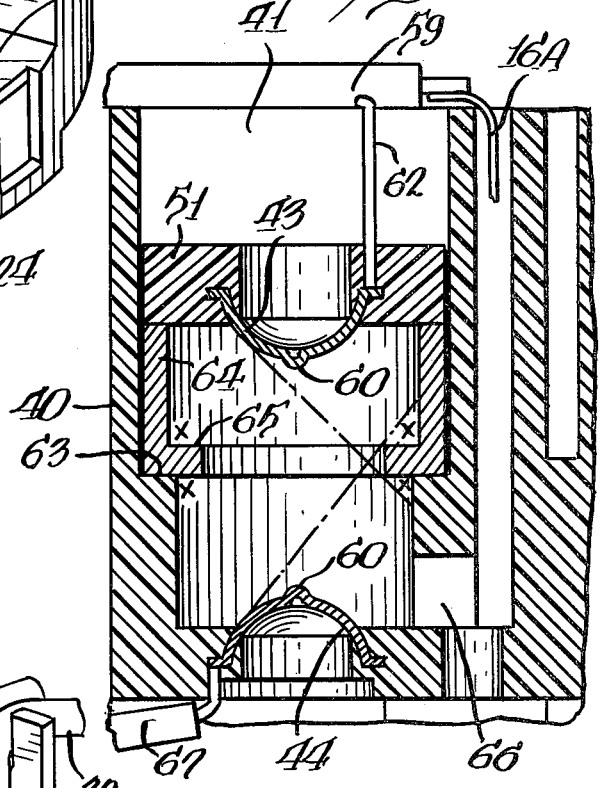

A portion of base 12 extends vertically to form a housing 40 which is substantially rectangular in plan view, on one side of base 12. Housing 40 contains or encloses the high voltage spark gap devices, see also FIG. 2. Housing 40 is divided into two similar but separate chambers or compartments 41 and 42 for housing or containing two distinct but similar set of spark gap electrodes. FIG. 2 shows a cross-sectional view of the housing 40 and one set of the spark gap ball electrodes 43 and 44 in chamber 41. Each ball electrode is substantially hemi-spherical and includes a central nipple 60 which extends toward the other electrode; this provides a reliable spark gap initiating point. As seen in FIG. 1, the housing 40 includes a central air space 45 formed by dielectric walls or barrier 46 and 47. The combination of the foregoing dielectric barrier walls and the air spaces therebetween provide improved thermal and dielectric characteristics for the socket assembly 11 substantially according to the concepts described in U.S. Pat. No. 3,771,024 and assigned to the same assignee as the present invention.

The chamber 41 tends to maintain the atmosphere therein constant and stable such that the spark gap formed between the two opposed electrodes 43 and 44 maintain a more constant arcing level.

It has been found that in certain multipotential applications, it is necessary that the spacing between pairs of ball electrodes be adjusted to arc at different high voltage ranges. Thus, in the embodiment shown, ball electrodes 43 and 44 are spaced at a greater distance than the electrodes in compartment 42 to accommodate a larger operating or arcing voltage.

As shown in FIG. 2, the ball electrode 43 is embedded or formed in a plastic plug 51 which conforms to the periphery of the chamber 41, and is received in chamber 41. The electrode 43 is connected as by lead 62 to the pin 16A and to the high voltage conductor 59. Chamber 41 includes an interior peripheral ledge 63 in which a hollow cup shaped ring spacer 64 is positioned. Spacer 64 includes an inwardly extending rim 65 for purposes to be described. The plug 51 including ball electrode 43 rests on the top of spacer 64.

The lower electrode 44 is embedded in the bottom of chamber 41 and its lower surface is open to the surroundings. A vent hole 66 vents the interior of chamber 41 to the surroundings. Electrode 44 is connected through lead 67 to ground reference.

An important feature of the invention are the structures shown in FIG. 2 which provides a corona disruption capability. Since corona precedes dielectric breakdown, a corona discharge adversely affects and changes the selected and pre-established voltage breakdown or arcing potential, between the electrodes. It has been found that with ball electrodes positioned in chamber 41 having smooth sides, a corona discharge path initiated at one electrode extends or moves along the walls of the chamber and thence tends to reduce the arcing potential between the two electrodes. As shown by the dashed lines 69 in FIG. 2, the rim or shoulder 65 on spacer 64 provides an effective barrier which interrupts the corona ionizing path track to thereby inhibit corona discharge. In effect the rim 65 provides a shadow area, indicated as X, from electrodes 43 or 44 to the wall of the chamber 41, which tends to inhibit establishing a corona discharge along the wall of the chamber.

While the invention has been particularly shown and described with reference to a preferred embodiment thereof, it will be understood by those skilled in the art, that various changes in form and details may be made therein without departing from the spirit and scope of the invention.

I claim:

1. A tube socket assembly having spark gap means for dissipating high voltage transients occurring at the terminal pins of an associated electron beam tube comprising, in combination:

a housing of dielectric material having an opening for receiving the terminal pins of the associated tube;

high voltage spark gap means;

dielectric means forming a high voltage spark gap chamber within said housing for receiving said high voltage spark gap means;

ledges extending inwardly from the walls of said chamber;

a hollow spacer of dielectric material and conforming to the interior dimensions of said chamber positioned on said ledges;

said high voltage spark gap means including first and second ball-type electrodes;

a plug module of dielectric material and conforming to the interior dimensions of said chamber positioned on said spacer;

said first electrode embedded in said plug;

said second electrode mounted within said chamber in spaced relation to said first electrode, with the spacing between said electrodes relating to said spacer; and said spacer having a rim extending inwardly into said chamber for providing a barrier for interrupting the corona ionizing path track to thereby inhibit corona discharge.

* * * * *